US008474243B2

(12) United States Patent
Kocher et al.

(10) Patent No.: US 8,474,243 B2
(45) Date of Patent: Jul. 2, 2013

(54) SYSTEM FOR CONTROLLING REGENERATION OF AN ADSORBER

(75) Inventors: Lyle E. Kocher, Franklin, IN (US); Michael Cunningham, Greenwood, IN (US)

(73) Assignee: Cummins, Inc., Columbus, IN (US)

( * ) Notice: Subject to any disclaimer, the term of this patent is extended or adjusted under 35 U.S.C. 154(b) by 991 days.

(21) Appl. No.: 12/004,584

(22) Filed: Dec. 21, 2007

(65) Prior Publication Data

US 2008/0173009 A1 Jul. 24, 2008

Related U.S. Application Data

(60) Provisional application No. 60/876,636, filed on Dec. 22, 2006.

(51) Int. Cl.
*F01N 3/00* (2006.01)

(52) U.S. Cl.
USPC ..... 60/286; 60/295; 60/297

(58) Field of Classification Search
USPC ..... 60/286
See application file for complete search history.

(56) References Cited

U.S. PATENT DOCUMENTS 5,406,790 A * 4/1995 Hirota et al. ..... 60/276
6,293,092 B1 9/2001 Ament et al.
6,327,851 B1 12/2001 Bouchez et al.
6,343,467 B1 * 2/2002 Muto et al. ..... 60/285
6,347,513 B2 2/2002 Pfleger et al.
6,408,615 B1 6/2002 Hahn
6,434,929 B1 8/2002 Nishimura et al.
6,594,985 B2 * 7/2003 Surnilla et al. ..... 60/277
6,615,580 B1 9/2003 Khair et al.
6,629,408 B1 10/2003 Murakami et al.
6,681,565 B2 1/2004 Russell
6,718,757 B2 4/2004 Khair et al.
6,722,120 B2 4/2004 Plote
6,722,121 B2 4/2004 Gui et al.
6,769,245 B2 8/2004 Itoh et al.
6,792,751 B2 9/2004 Kokusyo et al.
2002/0023432 A1 * 2/2002 Ishizuka et al. ..... 60/285
2002/0029562 A1 3/2002 Ishii et al.
2002/0050135 A1 5/2002 Manaka et al.
2002/0134075 A1 9/2002 Polach et al.
2004/0040291 A1 3/2004 Toshioka et al.
2004/0154288 A1 8/2004 Okada et al.
2004/0163381 A1 8/2004 Shirakawa et al.
2004/0168431 A1 9/2004 Goralski, Jr. et al.
2004/0187483 A1 9/2004 Dalla Betta et al.
2004/0194450 A1 10/2004 Tanaka et al.
2006/0254262 A1 * 11/2006 Chiba et al. ..... 60/295

* cited by examiner

*Primary Examiner* — Kenneth Bomberg
*Assistant Examiner* — Jason Shanske
(74) *Attorney, Agent, or Firm* — Krieg DeVault, LLP

(57) ABSTRACT

A system, method, and software for determining an amount of reductant to be supplied to a NOx adsorber during a regeneration event is disclosed. A reductant calculation module is executable by an electronic control unit for calculating a quantity of reductant delivered which is required to periodically regenerate the adsorber by accumulating the reductant fuel delivered as a function of a total fuel quantity being supplied to the internal combustion engine by a fuel system and subtracting an amount of fuel required to achieve a stoichiometric air to fuel ratio at an inlet of the adsorber.

30 Claims, 6 Drawing Sheets

SYSTEM FOR CONTROLLING REGENERATION OF AN ADSORBER

CROSS-REFERENCE TO RELATED APPLICATIONS

The present application claims the benefit of U.S. Provisional Patent Application No. 60/876,636 filed Dec. 22, 2006, which is incorporated herein by reference.

BACKGROUND

The present invention relates generally to exhaust treatment for an internal combustion engine and more particularly, but not exclusively, to a method, system, and software utilized to determine when to stop providing reductant to a $NO_x$ adsorber while operating in a regeneration mode.

The Environmental Protection Agency ("EPA") is working aggressively to reduce pollution from new, heavy-duty diesel trucks and buses by requiring them to meet tougher emission standards that will make new heavy-duty vehicles up to 95% cleaner than older vehicles. Emission filters in the exhaust gas systems of internal combustion engines are used to remove unburned soot particles from the exhaust gas and to convert harmful pollutants such as hydrocarbons ("HC"), carbon monoxide ("CO"), oxides of nitrogen ("$NO_x$"), and oxides of sulfur ("$SO_x$") into harmless gases.

$NO_x$ storage catalyst units or adsorbers are used to purify exhaust gases of combustion engines. Generally speaking, these $NO_x$ storage catalyst units store or trap $NO_x$ while the engine is operating in a lean mode and remove $NO_x$ from the adsorber while the engine is operating in a rich mode. One of the necessary steps to regenerate a respective adsorber is to consume all of the oxygen on the surface of the catalyst (referred to as the oxygen storage component ("OSC")). Before the oxygen on the surface of the adsorber can be consumed, the oxygen in the exhaust gas produced by the engine must first be consumed. Once this is accomplished, any additional reductant supplied will be used to consume the OSC on the surface of the adsorber and to regenerate the adsorber. Accordingly, there is a need for methods and systems for determining how much reductant should be supplied to an adsorber in order to properly regenerate the adsorber.

SUMMARY

One embodiment according to the present invention discloses a unique engine management system for determining how much reductant to supply to an adsorber to effectively regenerate the adsorber. Other embodiments include unique apparatuses, systems, devices, hardware, software, methods, and combinations of these for controlling regeneration of an adsorber utilized to convert harmful pollutants formed as a byproduct of the combustion process in an internal combustion engine into non-harmful substances. Further embodiments, forms, objects, features, advantages, aspects, and benefits of the present invention shall become apparent from the following description and drawings.

DETAILED DESCRIPTION OF ILLUSTRATIVE EMBODIMENTS

Figure 1:
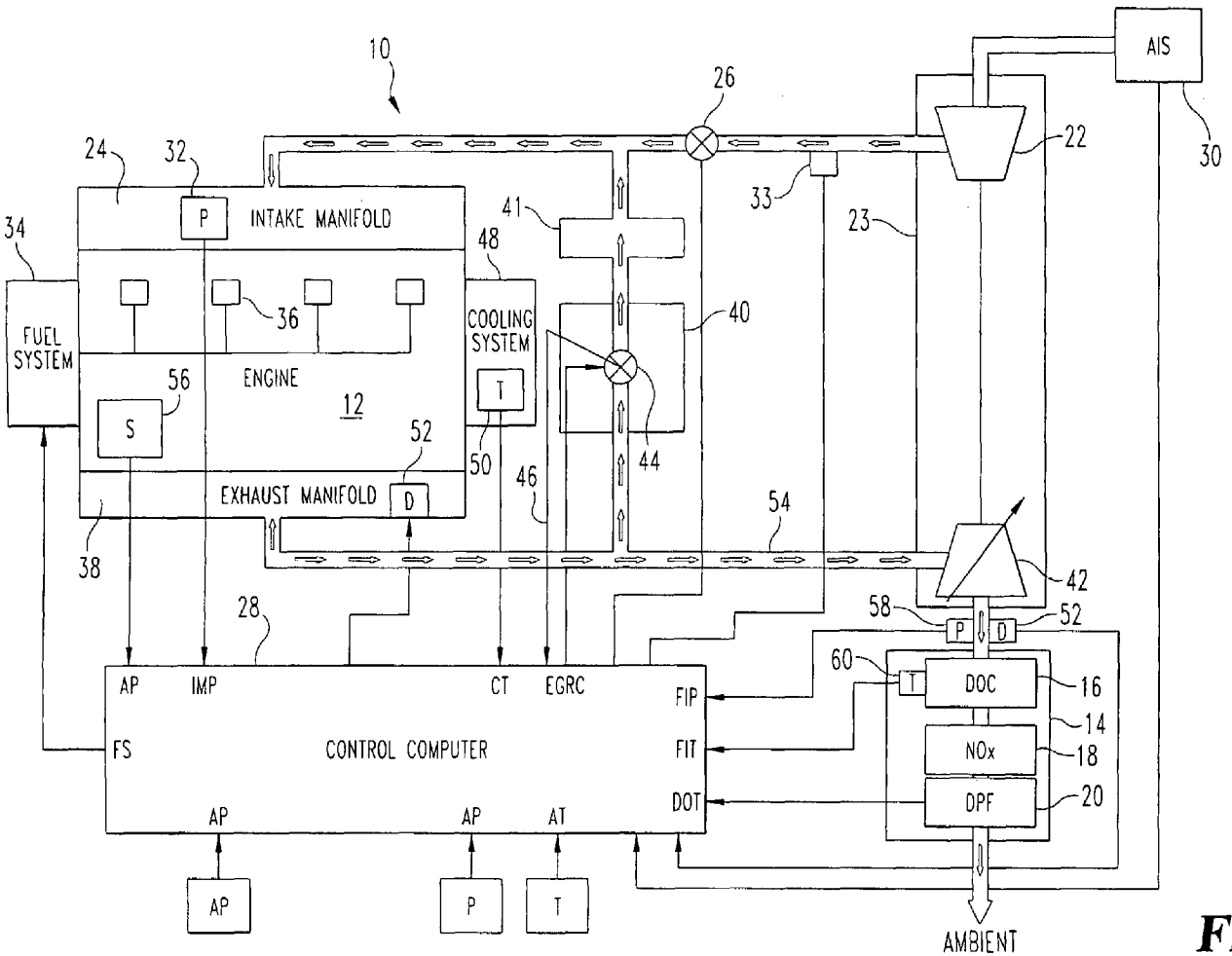
FIG. 1 is a schematic of a representative diesel engine system.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention is illustrated therein being contemplated as would normally occur to one skilled in the art to which the invention relates.

With reference to FIG. 1, there is illustrated, schematically, a system 10 that includes an internal combustion engine 12 operatively coupled with an exhaust filtration system 14. The exhaust filtration system 14 includes a diesel oxidation catalyst ("DOC") unit 16, a $NO_x$ adsorber or Lean $NO_x$ trap ("LNT") 18, and a diesel particulate filter ("DPF") 20. The exhaust filtration system 14 is operable to remove unwanted pollutants from exhaust gas exiting the engine 12 after the combustion process.

The DOC unit 16 is a flow through device that consists of a canister that may contain a honey-comb like structure or substrate. The substrate has a large surface area that is coated with an active catalyst layer. This layer may contain a small, well dispersed amount of precious metals such as, for example, platinum or palladium. As exhaust gas from the engine 12 traverses the catalyst, CO, gaseous HC and liquid HC particles (unburned fuel and oil) are oxidized, thereby reducing harmful emissions. The result of this process is that these pollutants are converted to carbon dioxide and water. In order to function properly, the DOC unit 16 must be heated to a minimum temperature value.

The $NO_x$ adsorber 18 is operable to absorb $NO_x$ created during the combustion process of the engine 12, thereby dramatically reducing the amount of $NO_x$ released into the atmosphere. The $NO_x$ adsorber 18 contains a catalyst that allows $NO_x$ to adsorb onto the catalyst. The process of adsorption releases carbon dioxide ("$CO_2$"). A byproduct of running the engine 12 in a lean mode is the production of $NO_x$. The $NO_x$ adsorber 18 stores or absorbs $NO_x$ under lean engine operating conditions (lambda>1) and releases and catalytically reduces the stored $NO_x$ under rich engine operating conditions (lambda<1).

Under $NO_x$ regeneration, when the engine is operating under a rich condition at a predetermined temperature range, a catalytic reaction occurs. The stored $NO_x$ is catalytically converted to nitrogen ("$N_2$") and released from the $NO_x$ adsorber 18 thereby regenerating the $NO_x$ adsorber 18. The $NO_x$ adsorber 18 also has a high affinity for trapping sulfur and desulfation, the process for the removal of stored sulfur from the $NO_x$ adsorber 18, also requires rich engine operation, but for a longer period of time and at much higher temperatures.

The DPF 20 may comprise one of several type of particle filters known and used in the art. The DPF 20 is utilized to capture unwanted diesel particulate matter ("DPM") from the flow of exhaust gas exiting the engine 12. DPM is sub-micron size particles found in diesel exhaust. DPM is composed of both solid and liquid particles and is generally classified into three fractions: (1) inorganic carbon (soot), (2) organic fraction (often referred to as SOF or VOF), and (3) sulfate fraction (hydrated sulfuric acid). The DPF 20 may be regenerated at regular intervals by combusting the particulates collected in the DPF 20 through exhaust manipulation or the like. Those skilled in the art would appreciate that, as it relates to the present invention, several different types of DPFs may be utilized in the present invention.

During engine operation, ambient air is inducted from the atmosphere and compressed by a compressor 22 of a turbocharger 23 before being supplied to the engine 12. The compressed air is supplied to the engine 12 through an intake manifold 24 that is connected with the engine 12. An air intake throttle valve 26 is positioned between the compressor 22 and the engine 12 that is operable to control the amount of charge air that reaches the engine 12 from the compressor 22. The air intake throttle valve 26 may be connected with, and controlled by, an electronic control unit ("ECU") 28, but may be controlled by other means as well. As such, the air intake throttle valve 26 is operable to control the amount of charge air entering the intake manifold 24 via the compressor 22.

An air intake sensor 30 is included either before or after the compressor 22 to monitor the amount of ambient air or charge air being supplied to the intake manifold 24. The air intake sensor 30 may be connected with the ECU 28 and is operable to generate electric signals that are indicative of the amount of charge air flow or as referred to hereinafter, fresh air flow ("FAF"). An intake manifold pressure sensor 32 is connected with the intake manifold 24. The intake manifold pressure sensor 32 is operative to sense the amount of air pressure in the intake manifold 24, which is indicative of the amount of air flowing or provided to the engine 12. The intake manifold pressure sensor 32 is connected with the ECU 28 and generates electric signals indicative of the pressure value that are sent to the ECU 28.

A mass air flow sensor or air flow sensor 33 is positioned in fluid communication with the intake manifold 24 of the engine 12. The air flow sensor 33 converts the amount of air drawn into the engine 12 into a voltage signal. The mass air flow sensor 33 is connected with the ECU 28 and provides the voltage signal as an input to the ECU 28. The air flow sensor 33 is positioned directly in the intake air stream, preferentially before the air intake throttle valve 26, where it can measure incoming air. As such, the air flow sensor 33 is capable of providing a signal indicative of the amount of air being supplied to intake manifold 24 and the hence, the engine 12, during the combustion process.

The system 10 may also include a fuel injection system 34 that is connected with, and controlled by, the ECU 28. The purpose of the fuel injection system 30 is to deliver fuel into the cylinders of the engine 12, while precisely controlling the timing of the fuel injection, fuel atomization, the amount of fuel injected, as well as other parameters. Fuel is injected into the cylinders of the engine 12 through one or more fuel injectors 36 and is burned with charge air received from the intake manifold 24. Various types of fuel injection systems may be utilized in the present invention, including, but not limited to, pump-line-nozzle injection systems, unit injector and unit pump systems, common rail fuel injection systems and so forth.

Exhaust gases produced in each cylinder during combustion leaves the engine 12 through an exhaust manifold 38 connected with the engine 12. A portion of the exhaust gas is communicated to an exhaust gas recirculation ("EGR") system 40 and a portion of the exhaust gas is supplied to a turbine 42. The turbocharger 23 may be a variable geometry turbocharger 23, but other turbochargers may be utilized as well. The EGR system 34 is used to cool down the combustion process by providing a predetermined amount of exhaust gas to the charge air being supplied by the compressor 22. Cooling down the combustion process reduces the amount of $NO_x$ produced during the combustion process. An EGR cooler 41 may be included to further cool the exhaust gas before being supplied to the air intake manifold 22 in combination with the compressed air passing through the air intake throttle valve 26.

The EGR system 40 includes an EGR valve 44 this is positioned in fluid communication with the outlet of the exhaust manifold 38 and the air intake manifold 24. The EGR valve 44 may also be connected to the ECU 28, which is capable of selectively opening and closing the EGR valve 44. The EGR valve 44 may also have incorporated therewith a differential pressure sensor that is operable to sense a pressure change, or delta pressure, across the EGR valve 44. A pressure signal 46 may also be sent to the ECU 44 indicative of the change in pressure across the EGR valve 44. The air intake throttle valve 26 and the EGR system 40, in conjunction with the fuel injection system 34, may be controlled to run the engine 12 in either a rich or lean mode.

As set forth above, the portion of the exhaust gas not communicated to the EGR system 40 is communicated to the turbine 42, which rotates by expansion of gases flowing through the turbine 42. The turbine 42 is connected to the compressor 22 and provides the driving force for the compressor 22 that generates charge air supplied to the air intake manifold 24. Some temperature loss in the exhaust gas typically occurs as the exhaust gas passes through the turbine 42. As the exhaust gas leaves the turbine 42, it is directed to the exhaust filtration system 14, where it is treated before exiting the system 10.

A cooling system 48 may be connected with the engine 12. The cooling system 48 is a liquid cooling system that transfers waste heat out of the block and other internal components of the engine 12. Typically, the cooling system 48 consists of a closed loop similar to that of an automobile engine. Major components of the cooling system include a water pump, radiator or heat exchanger, water jacket (which consists of coolant passages in the block and heads), and a thermostat. As it relates to the present invention, the thermostat 50, which is the only component illustrated in FIG. 1, is connected with the ECU 28. The thermostat 50 is operable to generate a signal that is sent to the ECU 28 that indicates the temperature of the coolant used to cool the engine 12.

The system 10 includes a doser 52 that may be located in the exhaust manifold 38 and/or located downstream of the exhaust manifold 38. The doser 52 may comprise an injector mounted in an exhaust conduit 54. For the depicted embodiment, the agent introduced through the doser 52 is diesel fuel; however, other embodiments are contemplated in which one or more different dosing agents are used in addition to or in lieu of diesel fuel. Additionally, dosing could occur at a different location from that illustrated. For example, a fuel-rich setting could be provided by appropriate activation of injectors (not shown) that provide fuel to the engine in such a manner that engine 12 produces exhaust including a controlled amount of un-combusted (or incompletely combusted) fuel (in-cylinder dosing). Doser 52 is in fluid communication with a fuel line coupled to the same or a different fuel source (not shown) than that used to fuel engine 12 and is also connected with the ECU 28, which controls operation of the doser 52.

The system 10 also includes a number of sensors and sensing systems for providing the ECU 28 with information relating to the system 10. An engine speed sensor 56 may be included in or associated with the engine 12 and is connected with the ECU 28. The engine speed sensor 56 is operable to produce an engine speed signal indicative of engine rotation speed that is provided to the ECU 28. A pressure sensor 58 may be connected with the exhaust conduit 54 for measuring the pressure of the exhaust before it enters the exhaust filtration system 14. The pressure sensor 58 may be connected with the ECU 28. If pressure becomes too high, this may indicate that a problem exists with the exhaust filtration system 14, which may be communicated to the ECU 28.

At least one temperature sensor 60 may be connected with the DOC unit 16 for measuring the temperature of the exhaust gas as it enters the DOC unit 16. In other embodiments, two temperature sensors 60 may be used, one at the entrance or upstream from the DOC unit 16 and another at the exit or downstream from the DOC unit 60. These temperature sensors are used to calculate the temperature of the DOC unit 16. In this alternative, an average temperature may be determined, using an algorithm, from the two respective temperature readings of the temperature sensors 60 to arrive at an operating temperature of the DOC unit 60.

Figure 2:
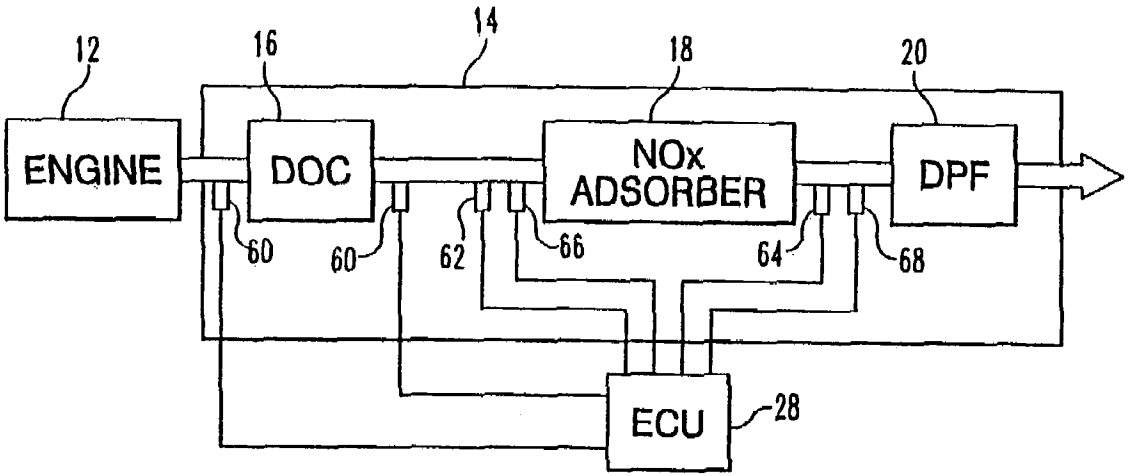
FIG. 2 is a more detailed schematic of the exhaust system of the representative diesel engine system.

Referring to FIG. 2, a more detailed diagram of the exhaust filtration system 14 is depicted connected in fluid communication with the flow of exhaust leaving the engine 12. A first $NO_x$ temperature sensor 62 may be in fluid communication with the flow of exhaust gas before entering or upstream of the $NO_x$ adsorber 18 and is connected to the ECU 28. A second $NO_x$ temperature sensor 64 may be in fluid communication with the flow of exhaust gas exiting or downstream of the $NO_x$ adsorber 18 and is also connected to the ECU 28. The $NO_x$ temperature sensors 62, 64 are used to monitor the temperature of the flow of gas entering and exiting the $NO_x$ adsorber 18 and provide electric signals that are indicative of the temperature of the flow of exhaust gas to the ECU 28. An algorithm may then be used by the ECU 28 to determine the operating temperature of the $NO_x$ adsorber 18.

A first universal exhaust gas oxygen ("UEGO") sensor or lambda sensor 66 may be positioned in fluid communication with the flow of exhaust gas entering or upstream from the $NO_x$ adsorber 18 and a second UEGO sensor 68 may be positioned in fluid communication with the flow of exhaust gas exiting or downstream of the $NO_x$ adsorber 18. The UEGO sensors 66, 68 are connected with the ECU 28 and generate electric signals that are indicative of the amount of oxygen contained in the flow of exhaust gas. The UEGO sensors 66, 68 allow the ECU 28 to accurately monitor air-fuel ratios ("AFR") also over a wide range thereby allowing the ECU 28 to determine a lambda value associated with the exhaust gas entering and exiting the $NO_x$ adsorber 18. In alternative embodiments, sensors 66, 68 may comprise $NO_x$ sensors utilized to monitor $NO_x$ values entering and exiting the $NO_x$ adsorber 18.

Figure 3:
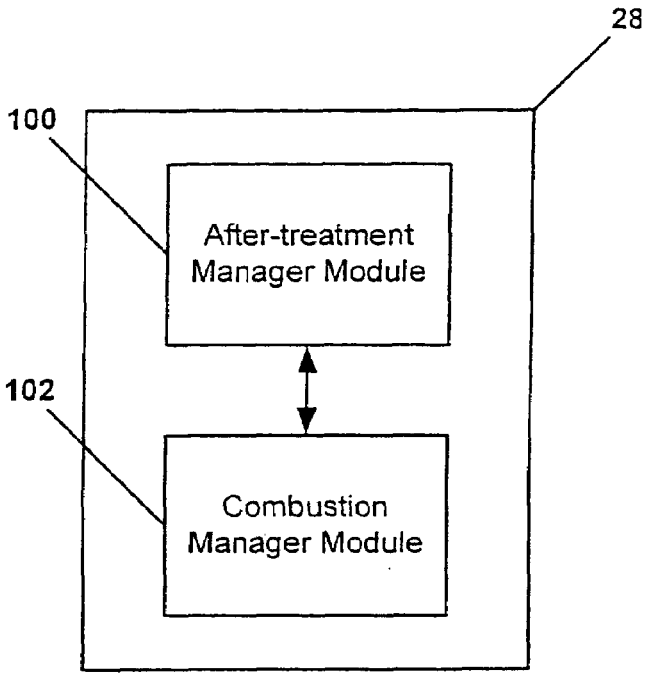
FIG. 3 is a block diagram illustrating an after-treatment manager module and a combustion manager module executable by the control unit.

Referring to FIG. 3, the system 10 includes an after-treatment manager module or software routine 100 and a combustion manager module or software routine 102 that are executable by the ECU 28. The after-treatment manager module 100 consists of computer executable code that is operable to generate control signals that are sent to the combustion manager module 102 for regenerating the $NO_x$ adsorber 18. The combustion manager module 102 consists of computer executable code that is operable to set target values to manage the combustion process of the engine 12. The combustion manager module 102 is capable of controlling the engine 12 such that the engine 12 may either operate in a lean operating mode or a rich operating mode. In particular, the combustion manager module 102 can provide exhaust gas to an inlet of the NOx adsorber 18 that is rich (has a higher concentration of unburned fuel than oxygen) or lean (has a higher level of oxygen than fuel).

Depending on the operating condition of the engine 12, for example, idle operation or under various driving conditions, the combustion manager module 102 may control output values for, amongst other parameters, the amount of fresh air flow and EGR flow that is permitted to enter the air intake manifold 26, the amount of fuel provided to cylinders and the timing of the fuel injection, fuel atomization, post-fuel injection, and so forth. As is relates to the present embodiment, the combustion manager module 102 is operable to control the engine 12 to operate in a lean operating mode or a rich operating mode when instructed by the after-treatment manager module 100.

As set forth above, the engine 12 includes an air intake system through which charge air is delivered to the cylinders into which fuel is injected at proper times during engine cycles by the fuel injectors 36. The engine 12 also includes an exhaust system for conveyance of exhaust gases created by the combustion process of the engine 12. The exhaust system 14 includes a $NO_x$ adsorber 18 that contains a catalyst that adsorbs $NO_x$ in the exhaust flow to limit the amount of $NO_x$ that passes through the exhaust system 14 to the environment. The $NO_x$ adsorber 18 also stores some of the excess oxygen present in the flow of exhaust. Regeneration of the $NO_x$ adsorber 18 is necessary in order to purge it of accumulated $NO_x$ and reduce the $NO_x$ to $N_2$ so that it can continue to be effective. Regeneration is accomplished by passing reductant through the $NO_x$ adsorber 18, comprises HC, CO and $H_2$. As it relates to the present system 10, reductant is supplied to the $NO_x$ adsorber 18 by controlling the engine 12 to operate in a rich mode.

There are two necessary steps to regenerate the catalyst contained in the $NO_x$ adsorber 18: 1) use the reductants to consume all of the oxygen stored on the $NO_x$ adsorber 18, and 2) use the reductants to remove the NOx stored on the $NO_x$ adsorber 18 and convert it to $N_2$. Before the oxygen stored on the surface of the $NO_x$ adsorber 18 can be consumed, the oxygen in the flow of exhaust gas exiting the engine 12 must first be consumed. Once this is accomplished, any additional reductant supplied to the $NO_x$ adsorber 18 is used to consume the oxygen storage component on the catalyst of the $NO_x$ adsorber 18 and remove and convert the $NO_x$ that is stored on the $NO_x$ adsorber 18.

The term or time period in which reductant is supplied to the $NO_x$ adsorber 18 is based upon an amount of reductant that is required to consume all of the stored oxygen on the surface of the $NO_x$ adsorber 18 and remove and convert the stored $NO_x$. The reductant amount needed to completely regenerate the $NO_x$ adsorber 18 will vary based on the type of catalyst, formulation, and age of the $NO_x$ adsorber 18. As set forth in detail below, the method for determining this term is to integrate the difference in the amount of fuel being supplied by the fuel system 34 (as seen by the first UEGO sensor 66 at the inlet of the $NO_x$ adsorber 18 and utilizing a fresh air flow ("FAF") value obtained by the mass air flow sensor 33) and the amount of fuel necessary to achieve a stoichiometric air to fuel ratio at the inlet of the $NO_x$ adsorber 18. After supplying the appropriate amount of reductant to the $NO_x$ adsorber 18, the regeneration will end and the engine operating condition is returned to normal by the combustion manager module 102.

Figure 4:
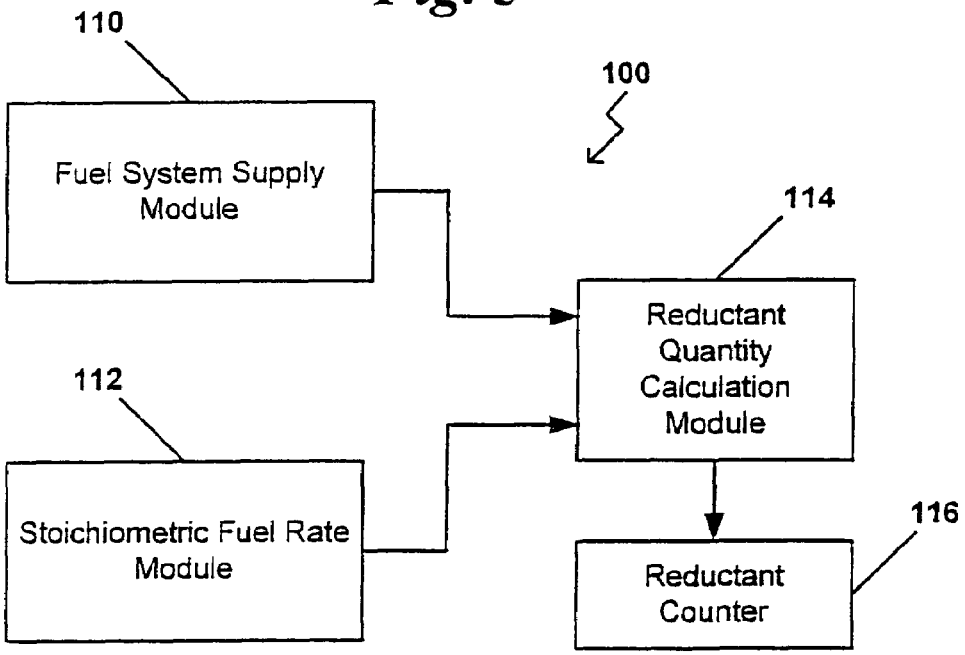
FIG. 4 is a more detailed block diagram of the after-treatment manager module.

Referring to FIG. 4, as generally set forth above, the amount of reductant required to be supplied to the $NO_x$ adsorber 18 to properly regenerate the $NO_x$ adsorber 18 is calculated as a function of the total amount of fuel being supplied to the engine 12 by the fuel system 34 as seen at the inlet of the $NO_x$ adsorber 18. The after-treatment manager module 100 includes a fuel system supply module 110 that keeps track of the total amount of fuel being supplied to the engine 12 by the fuel system 34 as seen at the inlet of the $NO_x$ adsorber 18. The fuel system supply module 110 is operable to generate outputs that are indicative of the amount of fuel being supplied by the fuel system 34.

Figure 5:
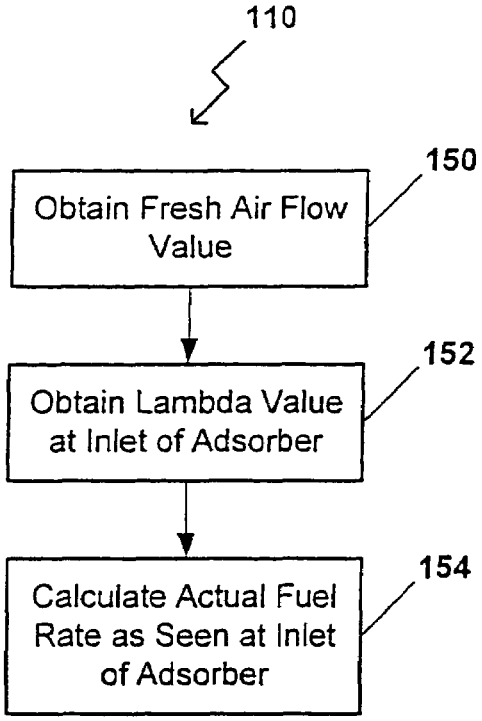
FIG. 5 is a block diagram of an actual fuel rate calculation process.

Referring to FIG. 5, the fuel system supply module 110 uses the mass air flow sensor 33 to obtain a fresh air flow value, which is represented at step 150. In addition, the fuel system supply module 110 uses the UEGO sensor 66 at the inlet of the $NO_x$ adsorber 18 to obtain a lambda value associated with the exhaust gas entering the $NO_x$ adsorber 18, which is represented at step 152. At step 154, the fuel system supply module 110 calculates the actual fuel rate as seen at the inlet of the $NO_x$ adsorber 18. The actual fuel rate as seen at the inlet of the $NO_x$ adsorber 18 is calculated using the following equation: $A_{FR}=FAF/(\lambda_{inlet}*14.7)$. The variable FAF is equal to the fresh air flow (lb/min) and the variable $\lambda_{inlet}$ is equal to the lambda value at the inlet of the $NO_x$ adsorber 18. A lambda value of 1 is equal to a stoichiometric air to fuel ratio, a lambda value less than 1 indicates a rich exhaust flow and a lambda value greater than 1 indicates a lean exhaust flow.

Referring back to FIG. 4, the after-treatment management module 100 includes a stoichiometric fuel rate module 112 that provides an indication of the amount of fuel necessary to achieve a stoichiometric air to fuel ratio at the inlet of the $NO_x$ adsorber 18. A stoichiometric air to fuel ratio 112 is where all of the fuel and oxygen content in the exhaust gas entering the $NO_x$ adsorber 18 have balanced each other out or were otherwise completely consumed during the combustion process such that no unburned fuel or oxygen enters the $NO_x$ adsorber 18. In most diesel fueled internal combustion engines, an air to fuel ratio of 14.7:1 (14.7 parts air to 1 part fuel) represents the chemically optimal point where stoichiometric combustion occurs in the cylinders of the engine 12. However, the stoichiometric air to fuel ratio is a property of a given type of fuel and will vary slightly for different types of fuel such as gasoline, diesel, biodiesel and other types of fuel. For the purpose of the present embodiment, the amount of fuel required to create a stoichiometric air to fuel ratio at the inlet of the $NO_x$ adsorber 18 is calculated as a function of the fresh air flow provided to the intake manifold 24 of the engine 12 as follows: Stoichiometric Fuel Rate=FAF/14.7.

After the total fuel quantity supplied by the fuel system 34 to the engine 12 has been determined using the fuel system supply module 110 and the amount of fuel necessary to create a stoichiometric air to fuel ratio at the inlet of the $NO_x$ adsorber 18 has been determined, these values are passed to a reductant calculation module 114. The reductant calculation module 114 is used to calculate an amount or quantity of reductant necessary to regenerate the $NO_x$ adsorber 18. To provide reductant to the $NO_x$ adsorber 18, the combustion manager module 102 uses engine management to operate the engine 12 in a rich operating mode. Controlling the engine 12 to operate in a rich mode, where the lambda value at the inlet of the $NO_x$ adsorber 18 is less than 1, places reductant in the flow of exhaust leaving the exhaust manifold 38.

The reductant calculation module 114 calculates how much reductant is being provided to regenerate the $NO_x$ adsorber 18 using the following equation: Regeneration Reductant=$\int(((FAF/\lambda_{inlet})-FAF)/14.7)*454/60*dt$. As such, the reductant calculation module 114 calculates the amount of reductant being supplied to regenerate the $NO_x$ adsorber 18 by integrating the difference in the amount of fuel being supplied by the fuel system 34 (as seen by the UEGO sensor 66 upstream from the $NO_x$ adsorber 18 and utilizing the fresh air flow value provided by the mass air flow sensor 33) and the amount of fuel necessary to achieve a stoichiometric air to fuel ratio at the entrance to the $NO_x$ adsorber 18.

Figure 6:
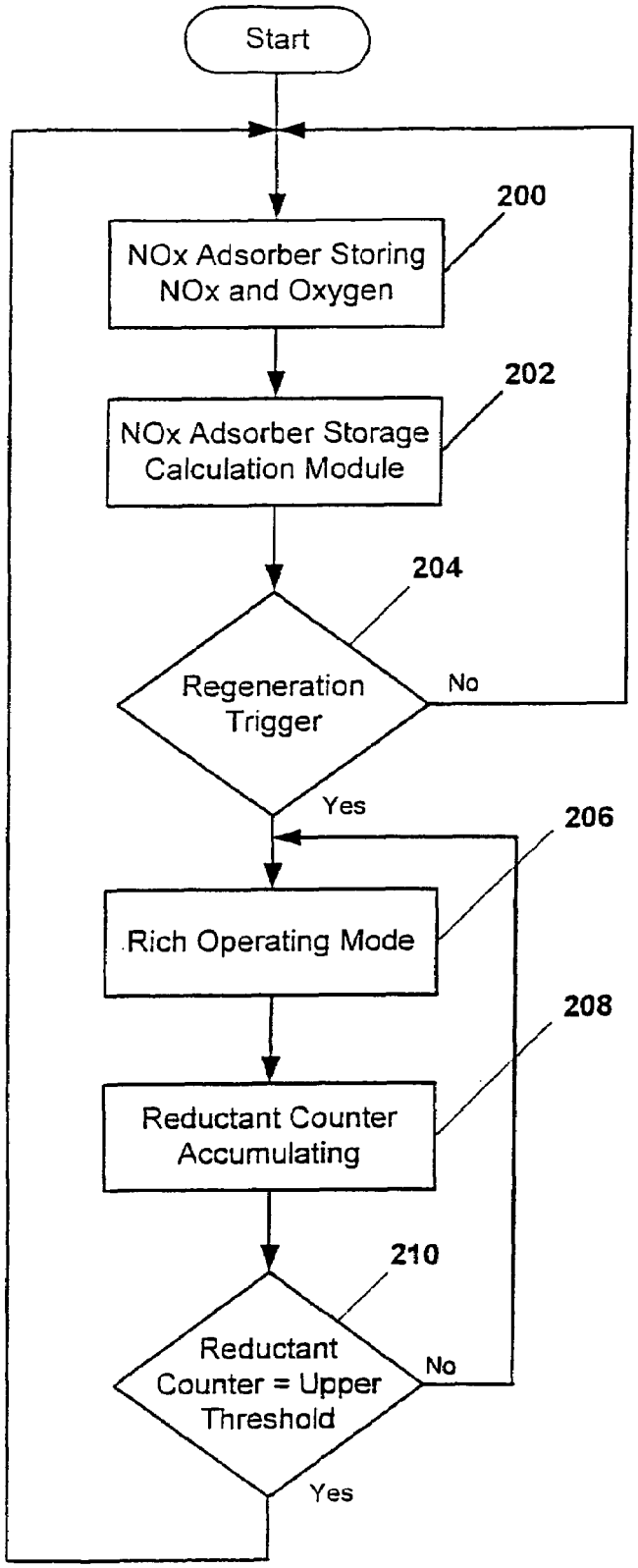
FIG. 6 is a block diagram of process steps performed by the after-treatment manager module and combustion manager module.

Referring to FIG. 6, during normal engine operation or when the engine 12 is operating in a lean mode, the $NO_x$ adsorber 18 is trapping or storing $NO_x$ and oxygen that is contained in the flow of exhaust exiting the exhaust manifold 38, which is represented at block 200. A $NO_x$ storage module, which is represented at block 202, contains logic operable to determine how much $NO_x$ and oxygen has been trapped or stored by the $NO_x$ adsorber 18, during normal engine operation. After a predetermined amount of time, based upon the logic determining how much $NO_x$ and oxygen has been stored in the catalyst of the $NO_x$ adsorber 18, the after-treatment manager module 100 will generate a regeneration trigger, which is represented at block 204. The regeneration trigger causes the combustion manager module 102 to switch engine operation to a rich operating mode, thereby providing reductant to the $NO_x$ adsorber 18, which is illustrated at block 206. As such, the lambda value sensed by the UEGO sensor 66 at the inlet of the $NO_x$ adsorber 18 will be less than 1 and preferably between 0.9-0.95. The fuel rate used to reduce the stored oxygen in the $NO_x$ adsorber 18 and remove and reduce the stored $NO_x$, is calculated by the reductant quantity calculation module 114 using the equation for the regeneration reductant previously described.

As the combustion manager module 102 controls the engine 12 to operate in a rich mode, reductant used to regenerate the $NO_x$ adsorber 18 is supplied to the $NO_x$ adsorber 18. The amount of reductant supplied to the $NO_x$ adsorber 18 during regeneration is cumulated by the reductant counter 116, which is illustrated at block 208. After the appropriate amount of reductant has been supplied to the $NO_x$ adsorber 18, once the reductant counter 116 reaches a calibrated high threshold value, the combustion manager module 102 returns the engine operating condition to normal operating mode, which is illustrated at block 210. The calibrated high threshold value is determined empirically and will vary based on many factors not limited to the catalyst type, formulation, and amount of $NO_x$ and oxygen stored between regeneration events.

Figure 7:
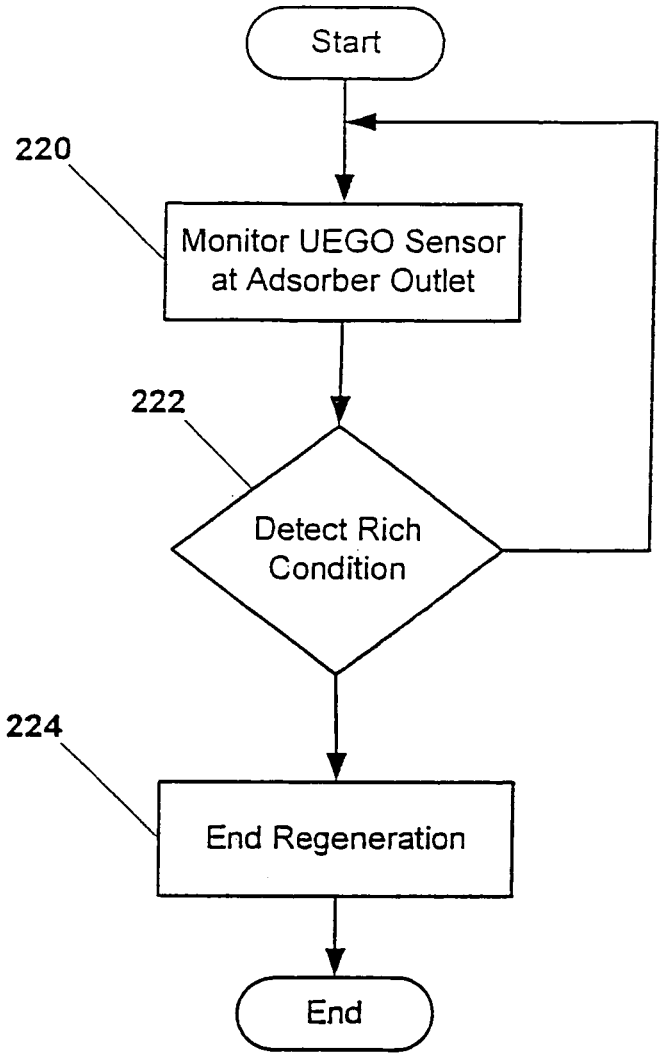
FIG. 7 is a block diagram of a failsafe to prevent hydrocarbon slip.

Referring to FIG. 7, a failsafe to prevent hydrocarbon ("HC") slip to the environment is also included in the present invention. The after-treatment manager module 100 monitors the second UEGO sensor 68 in fluid communication with the flow of exhaust gas exiting or downstream of the $NO_x$ adsorber 18, which is illustrated at block 220. If the UEGO sensor 68 reads or detects a rich stoichiometric condition (block 222), the after-treatment manager module 100 will immediately terminate an ongoing regeneration event, which is illustrated at block 224. If a rich condition is not detected, the ongoing regeneration event is allowed to continue. If the outlet of the $NO_x$ adsorber 18 is emitting a rich flow of exhaust gas, excess reductant beyond what is necessary to regenerate the catalyst in the $NO_x$ adsorber 18 is being supplied and slipped into the environment. The said hydrocarbon reading is considered positive when the measured lambda value at the outlet of said adsorber drops below a predetermined threshold near stoichiometry.

Additional control strategies may be implemented by the after-treatment manager module 100 built around the regeneration reductant term. For instance, if a regeneration event is forced to end prematurely, the after-treatment manager module 100 can determine how much reductant was supplied versus the target and schedule the next regeneration event earlier than normal to compensate for the previous incomplete regeneration event.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A system, comprising:

an internal combustion engine;

an exhaust manifold connected with said internal combustion engine for communicating a flow of exhaust gas to an adsorber;

an electronic control unit that is configured to execute a reductant calculation module that is configured to calculate a quantity of reductant required to periodically regenerate said adsorber as a function of a total fuel quantity being supplied to said internal combustion engine by a fuel system and an amount of fuel required to achieve a stoichiometric air to fuel ratio at an inlet of said adsorber;

wherein:

said electronic control unit is configured to calculate said total fuel quantity as a function of a measured exhaust air to fuel ratio as sensed by an oxygen sensor positioned upstream of said flow of exhaust entering said adsorber; and said electronic control unit is configured to, after calculating said quantity of reductant required to regenerate said adsorber, control said internal combustion engine to generate reductant that is supplied to said adsorber to regenerate said adsorber; and said electronic control unit is configured to return to a normal engine operating mode once said calculated quantity of reductant has been supplied to said adsorber and configured to return to said normal engine operating mode if reductant supplied to said adsorber is less than said calculated quantity of reductant and a hydrocarbon slip is detected at an output of said adsorber.

2. The system of claim 1, wherein said oxygen sensor is connected with said electronic control unit for providing electric signals to said electronic control unit indicative of said amount of oxygen in said flow of exhaust for use by said reductant calculation module in calculating said quantity of reductant.

3. The system of claim 1, wherein said total fuel quantity is further calculated as a function of an amount of fresh air being supplied to an intake manifold of said internal combustion engine.

4. The system of claim 3, wherein said amount of fresh air is sensed by a mass air flow sensor positioned in fluid communication with said intake manifold of said internal combustion engine.

5. The system of claim 4, wherein said mass air flow sensor is connected with said electronic control unit for providing electric signals to said electronic control unit indicative of said amount of fresh air.

6. The system of claim 1, wherein said amount of fuel required to achieve said stoichiometric air to fuel ratio at said inlet to said adsorber is calculated as a function of an amount of fresh air provided to said internal combustion engine.

7. The system of claim 6, wherein said amount of fresh air is divided by a predetermined stoichiometric value.

8. The system of claim 7, wherein said stoichiometric value is determined as a function of a type of fuel used in said engine.

9. The system of claim 1, wherein said reductant calculation module integrates a difference in said total fuel quantity and said amount of fuel required to achieve said stoichiometric air to fuel ratio to determine said quantity of reductant.

10. The system of claim 1, wherein said electronic control unit is configured to execute a combustion manager module that is configure to control said internal combustion engine to selectively provide said quantity of reductant to said inlet of said adsorber.

11. The system of claim 1, wherein said electronic control unit is configured to execute an actual fuel rate calculation module that is configured to generate an actual fuel rate at said inlet of said adsorber.

12. The system of claim 1, wherein said electronic control unit is configured to execute a regeneration fuel rate calculation module that is configured to calculate a fuel rate used to reduce oxygen and remove and convert stored $NO_x$ on said adsorber.

13. The system of claim 12, wherein said fuel rate is calculated as a function of said fresh air flow, a sensed lambda value at said inlet of said adsorber, and a predetermined stoichiometric air to fuel ratio of said engine.

14. The system of claim 13, wherein when said sensed lambda value at said inlet of said adsorber indicates a rich operating mode, said fuel rate is calculated by dividing said fresh air flow by said sensed lambda value times said predetermined stoichiometric air to fuel ratio of said engine and then subtracting that value by said fresh air flow divided by said predetermined stoichiometric air to fuel ratio.

15. A method, comprising:

communicating a flow of exhaust gas from an internal combustion engine to an adsorber;

calculating a quantity of reductant required to regenerate said adsorber as a function of a total amount of fuel supplied to said engine by a fuel system and an amount of fuel necessary to achieve a stoichiometric air to fuel ratio at an inlet of said adsorber, wherein said total amount of fuel supplied to said engine is determined by monitoring an oxygen sensor in fluid communication with a flow of exhaust gas entering said adsorber;

after calculating the quantity of reductant required to regenerate said adsorber, controlling said internal combustion engine to generate reductant that is supplied to said adsorber to regenerate said adsorber; and returning to a normal engine operating mode once said calculated quantity of reductant has been supplied to said adsorber and returning to the normal engine operating mode before supplying said calculated quantity of reductant to said adsorber if a hydrocarbon slip is detected at an output of the adsorber.

16. The method of claim 15, wherein said total amount of fuel supplied to said engine is further determined by monitoring a mass air flow sensor positioned in fluid communication with a flow of fresh air entering said engine.

17. The method of claim 15, wherein said quantity of reductant is calculated by integrating a difference in said total amount of fuel supplied to said engine and said amount of fuel necessary to achieve a stoichiometric air to fuel ratio at said inlet of said adsorber.

18. The method of claim 15, comprising calculating a cumulative reductant fuel quantity used to reduce stored oxygen and remove and reduce stored $NO_x$ in said adsorber when a lambda value at an inlet of said adsorber indicates a rich operating condition.

19. The method of claim 18, wherein said fuel rate is calculated as a function of a fresh air flow entering said engine, said lambda value at said inlet of said adsorber, and a predetermined stoichiometric value.

20. The method of claim 19, wherein said fresh air flow is divided by said lambda value multiplied by said predetermined stoichiometric value and that result is subtracted from said fresh air flow divided by said predetermined stoichiometric value.

21. The method of claim 15, further comprising monitoring an oxygen sensor at an outlet of said adsorber for a hydrocarbon reading, wherein if a positive hydrocarbon reading occurs said engine returns to a normal operating mode.

22. The method of claim 15, further comprising ceasing providing reductant to said adsorber if an interrupt event occurs, wherein an amount of reductant supplied prior to said interrupt event is compared to said quantity of reductant required to regenerate said adsorber and a following regeneration event is scheduled earlier to compensate for said interrupt event.

23. A system, comprising:

an internal combustion engine having an air intake manifold for communicating a fresh air flow to said internal combustion engine;

an exhaust manifold connected with said internal combustion engine for communicating an exhaust flow to an adsorber;

an electronic control unit configured to execute a combustion manager module that is configured to selectively operate said internal combustion engine in a rich mode in which a reductant is present in said exhaust flow for regenerating said adsorber; and said electronic control unit is configured to execute a reductant calculation module that is configured to calculate a cumulative reductant fuel quantity needed to regenerate said adsorber, wherein a reductant counter is used to track a quantity of reductant and a value associated with said reductant counter is increased while said internal combustion engine is operating in a rich mode as a function of a total fuel quantity being supplied to said internal combustion engine and an amount of fuel required to achieve a stoichiometric air to fuel ratio at an inlet of said adsorber, wherein said internal combustion engine is returned to a lean mode once the said reductant counter reaches a predetermined calibrated high threshold value and returned to said lean mode when said reductant counter is less than said predetermined calibrated high threshold value if a hydrocarbon slip is detected at an output of said adsorber, wherein said total fuel quantity is calculated as a function of a fuel rate as seen at said inlet of said adsorber.

24. The system of claim 23, wherein said fuel rate seen at said inlet of said adsorber is calculated using a reading from an oxygen sensor positioned upstream from said adsorber in fluid communication with said exhaust flow.

25. The system of claim 23, wherein said total fuel quantity is determined at least in part by a reading obtained from a mass air flow sensor positioned in fluid communication with said air intake manifold.

26. The system of claim 23, wherein said quantity of reductant is calculated by integrating a difference between said total fuel quantity being supplied to said internal combustion engine and said amount of fuel required to achieve said stoichiometric air to fuel ratio at said inlet of said adsorber.

27. A method, comprising:

tracking a total amount of fuel being supplied by a fuel system to an internal combustion engine during combustion, wherein said total amount of fuel being supplied by said fuel system is tracked by monitoring an amount of oxygen sensed by an oxygen sensor positioned upstream from a flow of exhaust entering an adsorber and by monitoring an amount of fresh air supplied to said internal combustion engine;

calculating an amount of reductant to regenerate said adsorber as a function of said total amount of fuel and an amount of fuel necessary to achieve a stoichiometric air to fuel ratio at an inlet to said adsorber;

after calculating the amount of reductant to regenerate said adsorber, regenerating said adsorber by supplying the calculated amount of reductant needed to regenerate said adsorber; and stopping said regeneration before supplying said calculated amount of reductant to said adsorber if an oxygen sensor at an outlet of said adsorber detects a hydrocarbon slip.

28. The method of claim 27, further comprising increasing a reductant counter associated with said amount of reductant while said internal combustion engine is operating in a rich mode as a function of said total amount of fuel and an amount of fuel necessary to achieve a stoichiometric air to fuel ratio at an inlet to said adsorber.

29. The method of claim 27, further comprising ending said regeneration of said adsorber once said reductant counter reaches a predetermined high threshold value.

30. The method of claim 27, wherein said stoichiometric air to fuel ratio at said inlet to said adsorber is calculated as a function of a fresh air flow and a predetermined stoichiometric value.

* * * * *